US007950641B2

(12) United States Patent
Kikkawa et al.

(10) Patent No.: US 7,950,641 B2
(45) Date of Patent: May 31, 2011

(54) SHEET CREASER, SHEET CONVEYER, SHEET FINISHER, AND IMAGE FORMING APPARATUS

(75) Inventors: Naohiro Kikkawa, Kanagawa (JP); Masahiro Tamura, Kanagawa (JP); Nobuyoshi Suzuki, Tokyo (JP); Shuuya Nagasako, Kanagawa (JP); Kazuhiro Kobayashi, Kanagawa (JP); Tomohiro Furuhashi, Kanagawa (JP); Makoto Hidaka, Tokyo (JP); Hitoshi Hattori, Tokyo (JP); Takashi Saito, Kanagawa (JP); Junichi Tokita, Kanagawa (JP); Akira Kunieda, Tokyo (JP); Atsushi Kuriyama, Aichi (JP); Hiroshi Maeda, Aichi (JP); Ichiro Ichihashi, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 283 days.

(21) Appl. No.: 12/314,599

(22) Filed: Dec. 12, 2008

(65) Prior Publication Data

US 2009/0152789 A1 Jun. 18, 2009

(30) Foreign Application Priority Data

Dec. 13, 2007 (JP) ..... 2007-322377

(51) Int. Cl.
*B31F 1/08* (2006.01)

(52) U.S. Cl. ..... 270/32; 270/45; 270/51; 270/58.07

(58) Field of Classification Search ..... 270/32, 270/37, 45, 51, 58.07, 58.08
See application file for complete search history.

(56) References Cited

U.S. PATENT DOCUMENTS

| | | | | |
|---|---|---|---|---|
| 6,905,118 | B2 * | 6/2005 | Yamada et al. | 270/8 |
| 7,306,214 | B2 | 12/2007 | Iida et al. | |
| 7,410,158 | B2 | 8/2008 | Iida et al. | |
| 7,416,177 | B2 | 8/2008 | Suzuki et al. | |
| 7,431,274 | B2 * | 10/2008 | Kushida et al. | 270/37 |
| 7,607,650 | B2 * | 10/2009 | Oikawa et al. | 270/58.07 |
| 2003/0215275 | A1 | 11/2003 | Tamura et al. | |
| 2004/0070133 | A1 * | 4/2004 | Yamada et al. | 270/32 |
| 2004/0256783 | A1 | 12/2004 | Iida et al. | |
| 2005/0189689 | A1 * | 9/2005 | Kushida et al. | 270/37 |
| 2006/0022394 | A1 | 2/2006 | Tamura et al. | |
| 2008/0179809 | A1 | 7/2008 | Kikkawa et al. | |
| 2009/0137374 | A1 * | 5/2009 | Kobayashi et al. | 493/424 |

FOREIGN PATENT DOCUMENTS

| | | |
|---|---|---|
| JP | 62-016987 | 1/1987 |
| JP | 2004-059304 | 2/2004 |
| JP | 4154318 | 11/2008 |

OTHER PUBLICATIONS

Abstract of JP 2005-162345 published Jun. 23, 2005.
Chinese Office Action dated Apr. 21, 2010 and English translation thereof.

* cited by examiner

*Primary Examiner* — Leslie A Nicholson, III
(74) *Attorney, Agent, or Firm* — Harness, Dickey & Pierce, P.L.C.

(57) ABSTRACT

In a sheet creaser, when a sheet is conveyed to a folding unit by a conveyer unit, the folding unit folds the sheet and a pressing unit presses the folded sheet by sliding in a direction substantially perpendicular to a sheet conveying direction. A switching unit switches the conveyer unit between a first position to convey the sheet and a second position unable to convey the sheet. A driving unit drives both the switching unit and the pressing unit.

13 Claims, 16 Drawing Sheets

SHEET CREASER, SHEET CONVEYER, SHEET FINISHER, AND IMAGE FORMING APPARATUS

CROSS-REFERENCE TO RELATED APPLICATIONS

The present application claims priority to and incorporates by reference the entire contents of Japanese priority document 2007-322377 filed in Japan on Dec. 13, 2007.

BACKGROUND OF THE INVENTION

1. Field of the Invention

The present invention relates to a sheet creaser, a sheet conveyer including a conveying path along which the sheet creaser is provided, a sheet finisher including the sheet creaser, an image forming apparatus including the sheet finisher or the sheet finisher.

2. Description of the Related Art

In the field of image forming apparatuses such as inkjet printers, electrophotographic copiers, facsimile machines, and multifunction products (MFPs), sheet finishers that receive a set of sheet-like recording mediums (hereinafter, "sheets") from an image forming apparatus and perform post-processing such as stapling have been widely used. With the development of multi-functional sheet finishers, sheet finishers with both a side-stitch function and a saddle-stitch function have appeared. In most of the sheet finishers with the saddle-stitch function, a folding unit that folds the set of sheets includes at least one pair of rollers called pressure rollers and a plate member called folding plate. More particularly, the folding plate is aligned with a line to be folded of the set of sheets, and inserts the set of sheets into a nip between the pressure rollers. Thus, a crease is made along the line to be folded on the set of sheets with the nip.

Some folding units include a first pair of pressure rollers and a second pair of pressure rollers. The set of sheets is pressed twice with the first pressure rollers and the second pressure rollers, which makes a stronger crease.

However, even when the set of sheets is pressed twice, it is difficult to make a crease strong enough due to a short pressing time and a low pressing force. Because a rotation axis of the pressure rollers runs parallel to a direction perpendicular to a sheet conveying direction, a folded side of the set of sheets is pressed in the nip between the pressure rollers only for a short time. Moreover, because the pressure rollers nip the entire folded side at the same time, the pressing force on the set of sheets is distributed, i.e., the pressing force per unit area is low.

To solve the above problems, Japanese Patent Application Laid-open No. S62-16987 discloses a technology for making the stronger crease with a slidable pressure roller. More particularly, after the folding plate inserts the set of sheets into the nip between the pressure rollers and thereby the set of sheets is half-folded, the slidable pressure roller re-presses the folded side while sliding on the folded side in the direction perpendicular to the sheet conveying direction by an operation of a screw.

Because the folded side is pressed with the slidable pressure roller sliding in the direction perpendicular to the sheet conveying direction, the pressing force is applied only at one point of the folded side making a contact with the slidable pressure roller at a time. Because the slidable pressure roller slides on the folded side, the entire folded side is pressed with the high pressing force. As a result, the strong crease is made on the set of sheets. However, just when sliding up on the folded side, the slidable pressure roller may push the sheets in the sliding direction. As a result, the slidable pressure roller may fail to evenly press the entire length of the folded side.

Japanese Patent Application Laid-open No. 2005-162345 discloses a technology for making an evenly-pressed stronger crease by preventing such an undesired displacement of the sheets in the sliding direction caused by the pressing force when the slidable pressure roller slides up on the sheets. More particularly, the sheet finisher according to Japanese Patent Application Laid-open No. 2005-162345 includes a guiding unit, the slidable pressure roller, and a supporting member. The guiding unit guides a half-folded recording medium P from the pressure rollers to the slidable pressure roller. The slidable pressure roller re-presses the folded side of the recording medium P, sliding in the direction perpendicular to the sheet conveying direction. The supporting member supports side surfaces of the recording medium P during the slide-pressing performed by the slidable pressure roller.

The supporting member that supports the sides of the sheets during the slide-pressing of the folded side by the slidable pressure roller is effective in preventing the undesired displacement of the sheets in the sliding direction, and thereby the evenly-pressed stronger crease is made without fails. However, a setting space for the supporting member is required and a space for a mechanism for driving the supporting member increases. Therefore, it is disadvantageous from the viewpoint of downsizing.

SUMMARY OF THE INVENTION

It is an object of the present invention to at least partially solve the problems in the conventional technology.

According to an aspect of the present invention, there is provided a sheet creaser that includes a conveyer unit that receives a sheet set including at least one sheet and conveys the sheet set; a folding unit that receives the sheet set from the conveyer unit and folds the sheet set along a folding line thereby obtaining a folded sheet set having a folded side; a pressing unit that presses the folded side of the folded sheet set by sliding back and forth in a direction substantially perpendicular to a conveying direction of the sheet set; a switching unit that switches the conveyer unit between a first position to convey the sheet set and a second position unable to convey the sheet set; and a driving unit that commonly drives the switching unit and the pressing unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
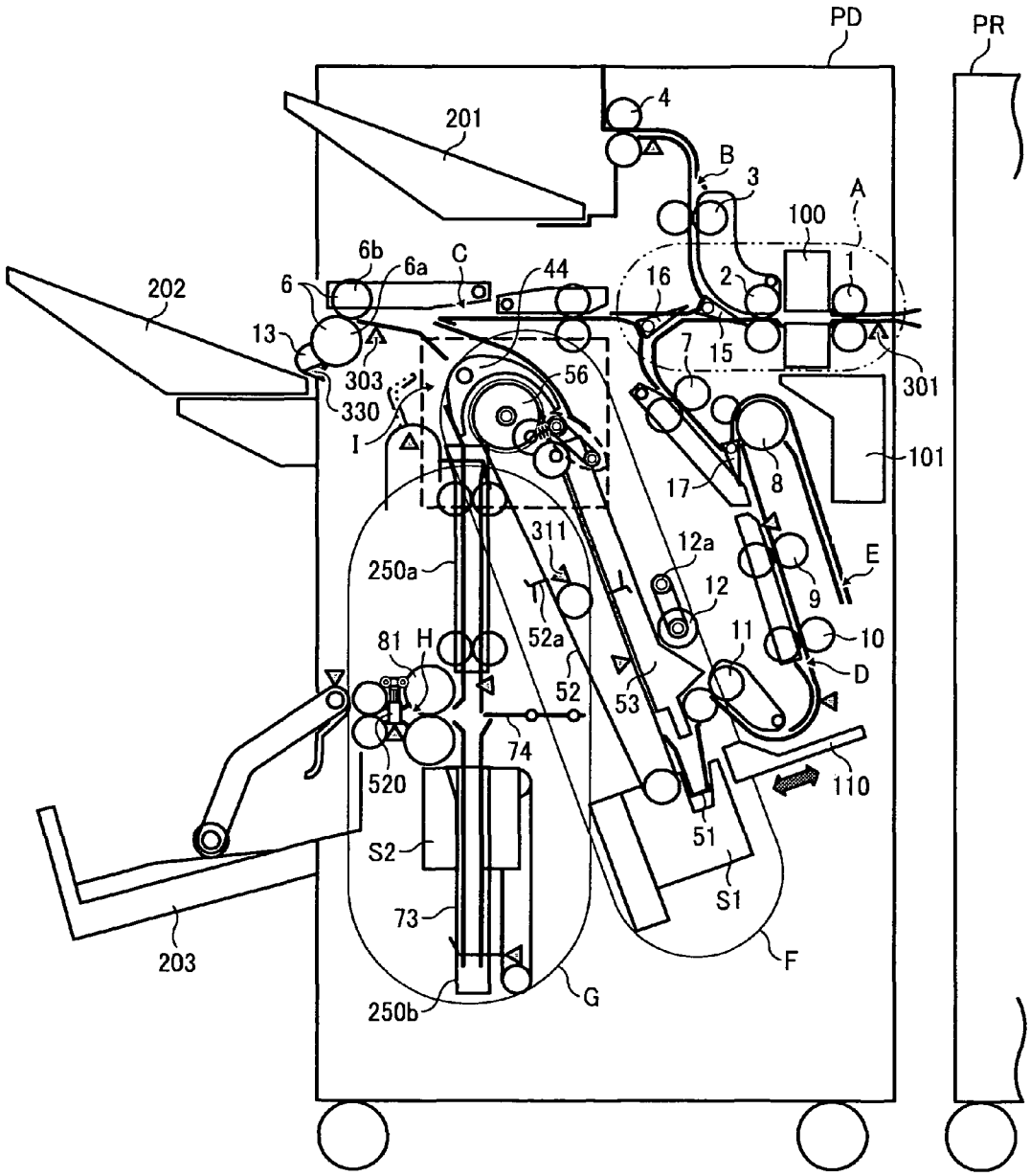
FIG. 1 is a schematic diagram of a system including a sheet finisher and an image forming apparatus according to an embodiment of the present invention.

FIG. 1 is a schematic diagram of the structure of a system including a sheet finisher PD as a sheet post-processing device and an image forming apparatus PR according to an embodiment of the present invention.

The sheet finisher PD is attached to a side of the image forming apparatus PR. A sheet ejected from the image forming apparatus PR is conveyed to the sheet finisher PD. The sheet passes through a conveyer path A for single-sheet processing (e.g., a punching unit 100 is located near the conveyer path A). After that, the sheet is conveyed by the operation of switching claws 15 and 16 to any one of a conveyer path B connecting to an upper tray 201, a conveyer path C connecting to a shift tray 202, a conveyer path D connecting to a side-stitch tray F for alignment and stapling.

The image forming apparatus PR includes, although not shown in the drawings, an image processing circuit for converting received image data into printable image data, an optical writing device that writes a latent image with a light on a photosensitive element based on an image signal received from the image processing circuit, a developing device that develops the latent image to a toner image, a transferring device that transfers the toner image onto a sheet, and a fixing device that fixes the toner image on the sheet. The image forming apparatus PR sends the sheet with the fixed toner image to the sheet finisher PD. Upon receiving the sheet from the image forming apparatus PR, the sheet finisher PD performs a certain post-processing with the sheet. Although the above explanation is made assuming that the image forming apparatus PR is an electrophotographic machine, the image forming apparatus PR can be any type of image forming apparatus such as an inkjet machine or a thermal-transfer machine.

After the alignment and stapling is performed at the side-stitch tray F with the sheet that has been passed through the conveyer paths A and D, the sheet is conveyed by the operation of a guiding member 44 to either the conveyer path C connecting to the shift tray 202 or a saddle-stitch tray G for saddle-stitch and folding. If the sheet is conveyed to the saddle-stitch tray G, the sheet is folded or the like at the saddle-stitch tray G. The folded sheet is conveyed to a conveyer path H and ejected onto a lower tray 203. The conveyer path D is provided with a switching claw 17 that keeps a position as shown in FIG. 1 by support of a low load spring (not shown). After the back end of the sheet passes the switching claw 17 while the sheet is conveyed by rotation of a pair of conveyer rollers 7, the sheet is reversed along a turn guiding member 8 by reverse-rotation of a pair of conveyer rollers 9, in some cases, together with reverse-rotation of at least one of a pair of conveyer rollers 10 and a pair of stapled-sheet conveyer rollers 11 (brush rollers). Thus, the sheet is conveyed with the back end ahead to a sheet accommodating unit E for pre-stacking. When the next sheet is conveyed to the sheet accommodating unit E, the two sheets are conveyed out of the sheet accommodating unit E overlapped with each other. It is possible to convey three or more sheets overlapped with one another by repeating those operations.

An entrance sensor 301 that detects the sheet coming from the image forming apparatus PR, a pair of entrance rollers 1, the punching unit 100, a punch-waste hopper 101, a pair of conveyer rollers 2, and the switching claws 15 and 16 are arranged near the conveyer path A in this order, with the entrance sensor 301 being closest to the image forming apparatus PR. The switching claws 15 and 16 keep positions as shown in FIG. 1 by support of springs (not shown). When corresponding solenoids (not shown) are turned ON, the switching claws 15 and 16 switch ON. The sheet is conveyed to one of the conveyer paths B, C, and D depending on a switching pattern of the switching claws 15 and 16.

When the sheet is to be conveyed to the conveyer path B, the solenoids are kept OFF, and thereby the switching claws 15 and 16 are in the positions shown in FIG. 1. As a result, the sheet is conveyed to the shift tray 202 though a pair of conveyer rollers 3 and a pair of ejection rollers 4. When the sheet is to be conveyed to the conveyer path C, the both solenoids are turned ON so that the switching claw 15 turns upward and the switching claw 16 turns downward. Thus, the sheet is conveyed to the shift tray 202 through a pair of ejection rollers 6. When the sheet is to be conveyed to the conveyer path D, the solenoid for the switching claw 16 is turned OFF and the solenoid for the switching claw 15 is turned ON so that the switching claw 15 turns upward and the switching claw 16 turned downward.

The sheet finisher PD can perform various sheet processing including punching using the punching unit 100, alignment and side stitch using a pair of jogger fences 53 and a side-stitch stapler S1, alignment and saddle stitch using an upper saddle-stitch jogger fence 250*a*, a lower saddle-stitch jogger fence 250*b*, and a saddle-stitch stapler S2, sorting using the shift tray 202, half-folding using a folding plate 74 and a pair of first pressure rollers 81. Moreover, the sheet finisher PD can perform slide-pressing using a slide-pressing unit 525 (see FIG. 15) as a subsequent process of the half-folding to make a crease on the folded sheet set stronger.

As show in FIG. 1, a sheet ejecting unit that ejects the sheets on the shift tray 202 includes the ejection rollers 6 (6*a*, 6*b*), a reverse roller 13, a sheet sensor 330, the shift tray 202, a shifting mechanism that shifts the shift tray 202 back and forth in a direction perpendicular to the sheet conveying direction, and a lifting mechanism that lifts the shift tray 202 up and down.

The reverse roller 13 is made of sponge. When the sheet is ejected by the ejection rollers 6, the reverse roller 13 comes in contact with the sheet so that the back end of the sheet abuts against an end fence, which makes the sheets stacked on the shift tray 202 aligned. The reverse roller 13 rotates by the rotation of the ejection rollers 6. There is a lift-up stop switch (not shown) near the reverse roller 13. When the shift tray 202 lifts up and pushes the reverse roller 13 up, the lift-up stop switch turns ON and a shift-tray lifting motor (not shown) stops. Thus, the shift tray 202 cannot move up beyond a predetermined position.

The sheet sensor 330 is arranged near the reverse roller 13. The sheet sensor 330 detects a position of the top one out of sheets stacked on the shift tray 202. When it is determined using the sheet sensor 330 that the position of the top sheet reaches a predetermined height, the shift tray 202 moves down by a predetermined amount by the action of the shift-tray lifting motor so that the position of the top sheet is always at the same level.

The ejection rollers 6 are formed with a driving roller 6*a* and a driven roller 6*b*. The driven roller 6*b* is arranged upstream of the driving roller 6*a*, and is rotatably attached to a free end of an open/close guiding plate. The open/close guiding plate is attached to the sheet finisher PD rotatably around the other end, arranged with the free end being closer to the shift tray 202. The driven roller 6*b* comes in contact with the driving roller 6*a* under the weight of the driven roller 6*b* or by a biasing force, and the sheet is ejected through between the driving roller 6*a* and the driven roller 6*b*. When stapled sheets are to be ejected, the open/close guiding plate moves up to a predetermined position, and then moves down at predetermined timing decided based on a detection signal from an ejection sensor 303. The predetermined position is decided based on a detection signal from a guiding-plate open/close sensor (not shown). The open/close guiding plate moves up, driven by a guiding-plate open/close motor (not shown).

When the sheet is conveyed to the side-stitch tray F by the rotation of the stapled-sheet conveyer rollers 11, the sheet is stacked on the side-stitch tray F. More particularly, the sheet goes backward by rotation of a reverse roller 12 in the vertical direction (i.e., the sheet conveying direction), and abut against an end fence 51, which makes the sheets stacked on the side-stitch tray F aligned. A direction perpendicular to the sheet conveying direction (i.e., the sheet-width direction) is aligned with the jogger fences 53. When it is determined based on a staple signal from a control circuit 350 that a last one of a set of sheets is stacked on the side-stitch tray F, the side-stitch stapler S1 stapes the set of sheets. A sheet pressing member 110 presses a side of the set of sheets when the side-stitch stapler S1 staples the sheets.

A home position (HP) of a lifting claw 52*a* is detected with an ejection-belt HP sensor 311. The ejection-belt HP sensor 311 turns ON/OFF by operation of the lifting claw 52*a* attached to a lifting belt 52. Two lifting claws 52*a* are attached to an outer surface of the lifting belt 52, with the lifting claws 52*a* being opposed to each other. The two lifting claws 52*a* alternately lift the set of sheets out of the side-stitch tray F.

The lifting belt 52 rotates between a driving pulley and a driven pulley along a center line of the aligned sheet width. A plurality of lifting rollers 56 are attached rotatably to a driving shaft, working as driven rollers. The lifting rollers 56 are arranged symmetric to each other with respect to the lifting belt 52.

The reverse roller 12 swings around a fulcrum 12*a* by a tapping solenoid, which causes the back end of the sheets stacked on the side-stitch tray F to abut against the end fence 51. The reverse roller 12 rotates counterclockwise. The pair of jogger fences 53 is arranged so that both width-direction sides of the stacked sheets put between them. The jogger fences 53 slide in the sheet-width direction back and forth via a timing belt (not shown) by positive-driving or negative-driving of a jogger motor (not shown). The side-stitch stapler S1 moves to a target position in the sheet-width direction via a timing belt (not shown) by positive-driving or negative-driving of a stapler moving motor (not shown) to staple the target position of the sheet side.

A saddle-stitch mechanism related to the slide-pressing process is explained below. A side-stitch mechanism is not explained, because the side-stitch mechanism is not a feature of the sheet finisher PD.

Figure 2:
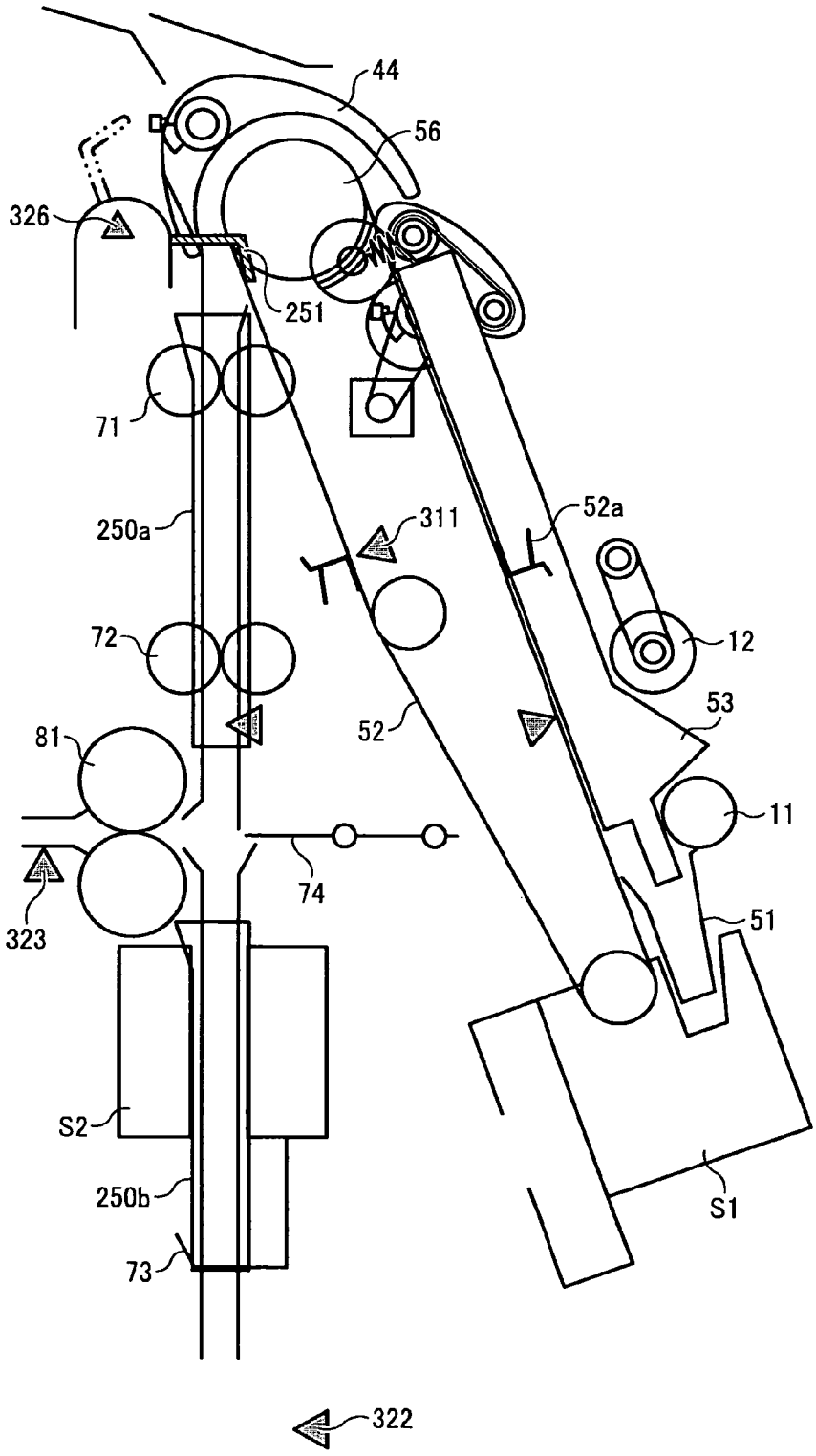
FIG. 2 is a schematic diagram of a side-stitch tray and a saddle-stitch tray shown in FIG. 1, viewed from the front side of the sheet finisher.
Figure 3:
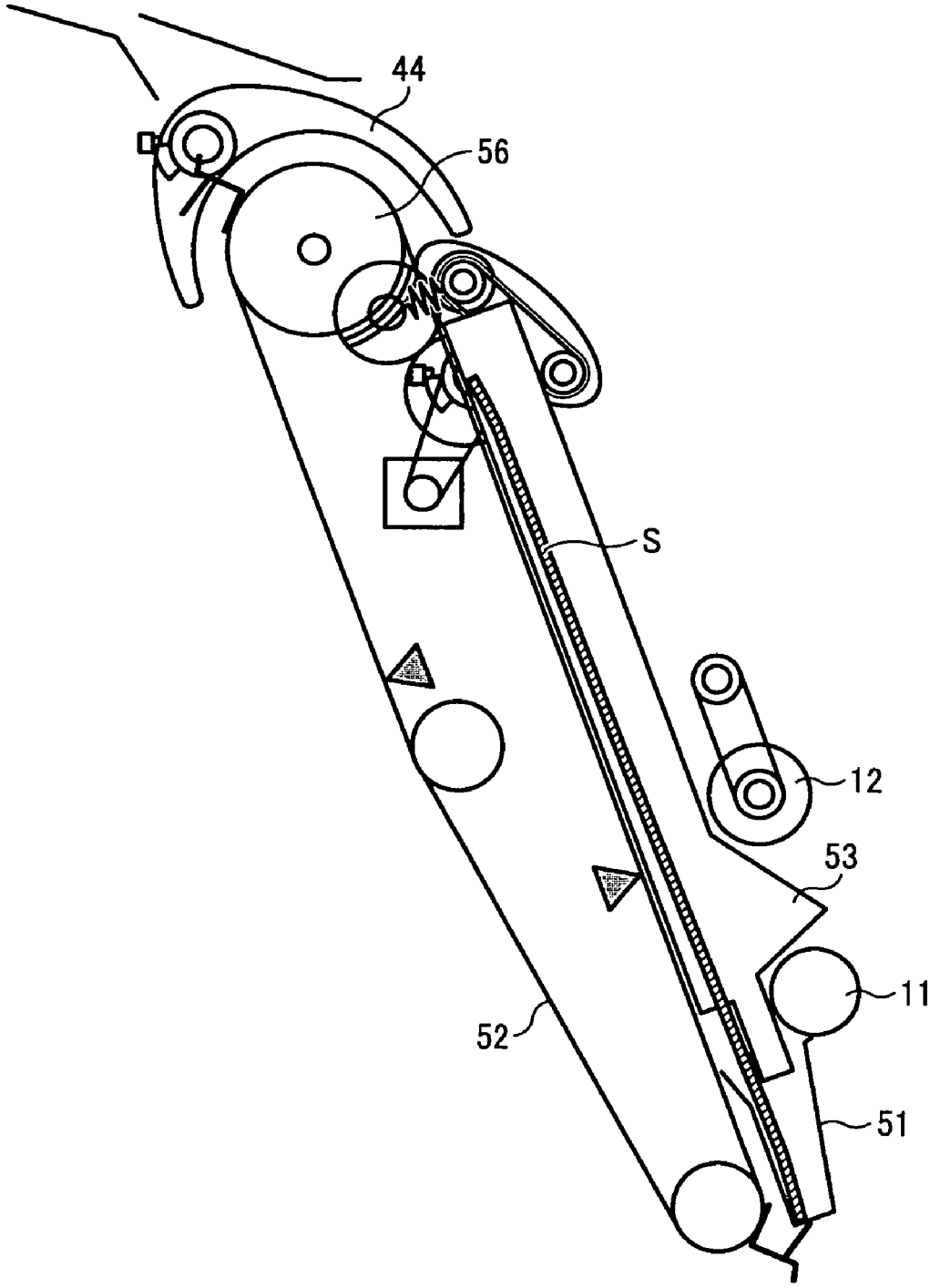
FIGS. 3 to 10 are schematic diagrams for explaining operations in a saddle-stitch mode according to the embodiment.

FIG. 2 is a schematic diagram of the side-stitch tray F and the saddle-stitch tray G viewed from the front side of the sheet finisher PD. FIGS. 3 to 10 are schematic diagrams for explaining operations in a saddle-stitch mode.

It is assumed that the sheet is conveyed to the conveyer path D by the operation of the switching claws 15 and 16, and then is conveyed to the side-stitch tray F by the operation of the conveyer rollers 7, 9, and 10, and the stapled-sheet conveyer rollers 11. At the side-stitch tray F, the sheet is aligned with the stapled-sheet conveyer rollers 11 both in the saddle-stitch mode and the side-stitch mode (see FIG. 3). In other words, the operations in the saddle-stitch mode and the stapling mode are same before a set of sheets is stapled in the side-stitch mode.

Figure 4:
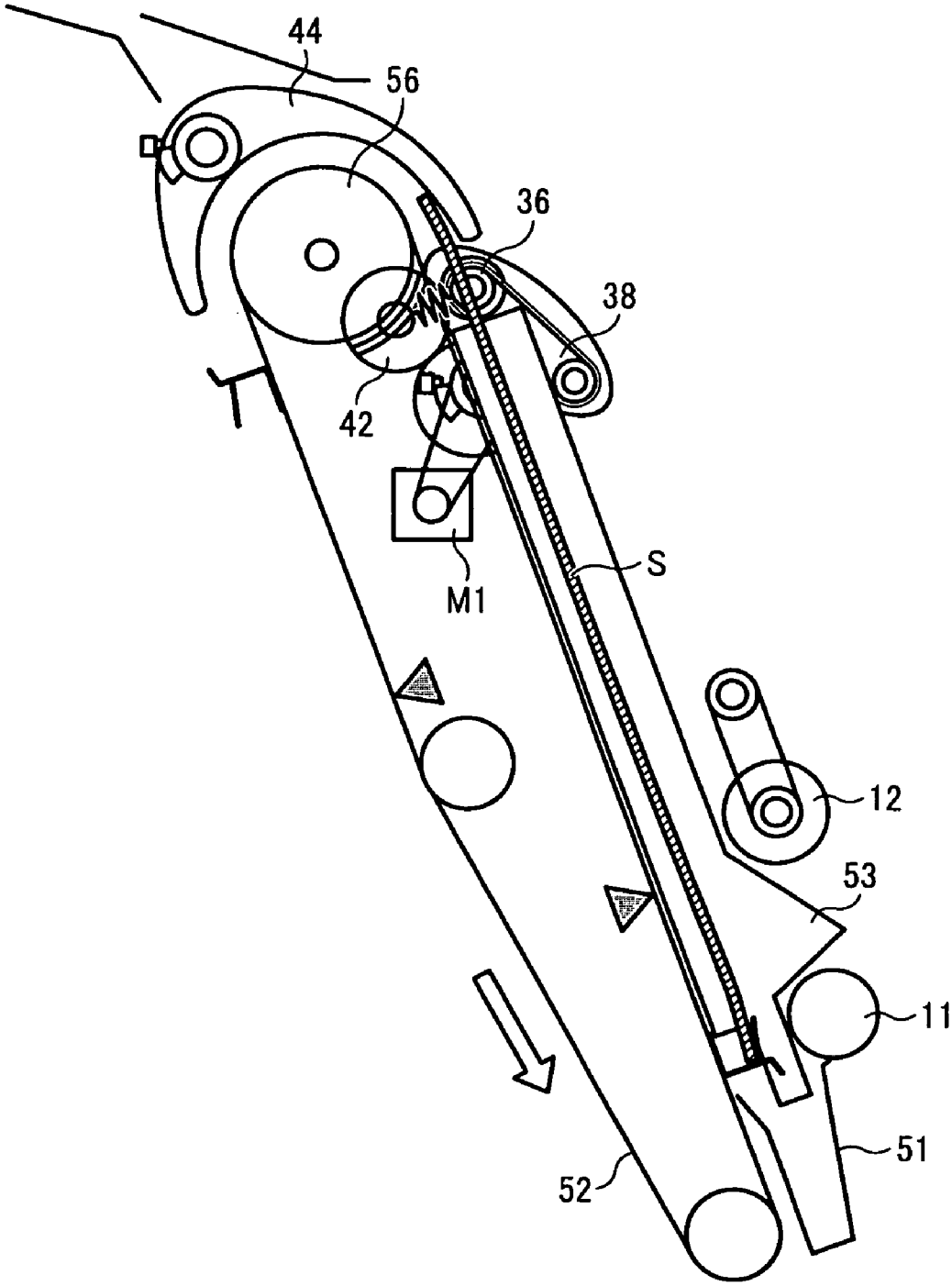
Figure 5:
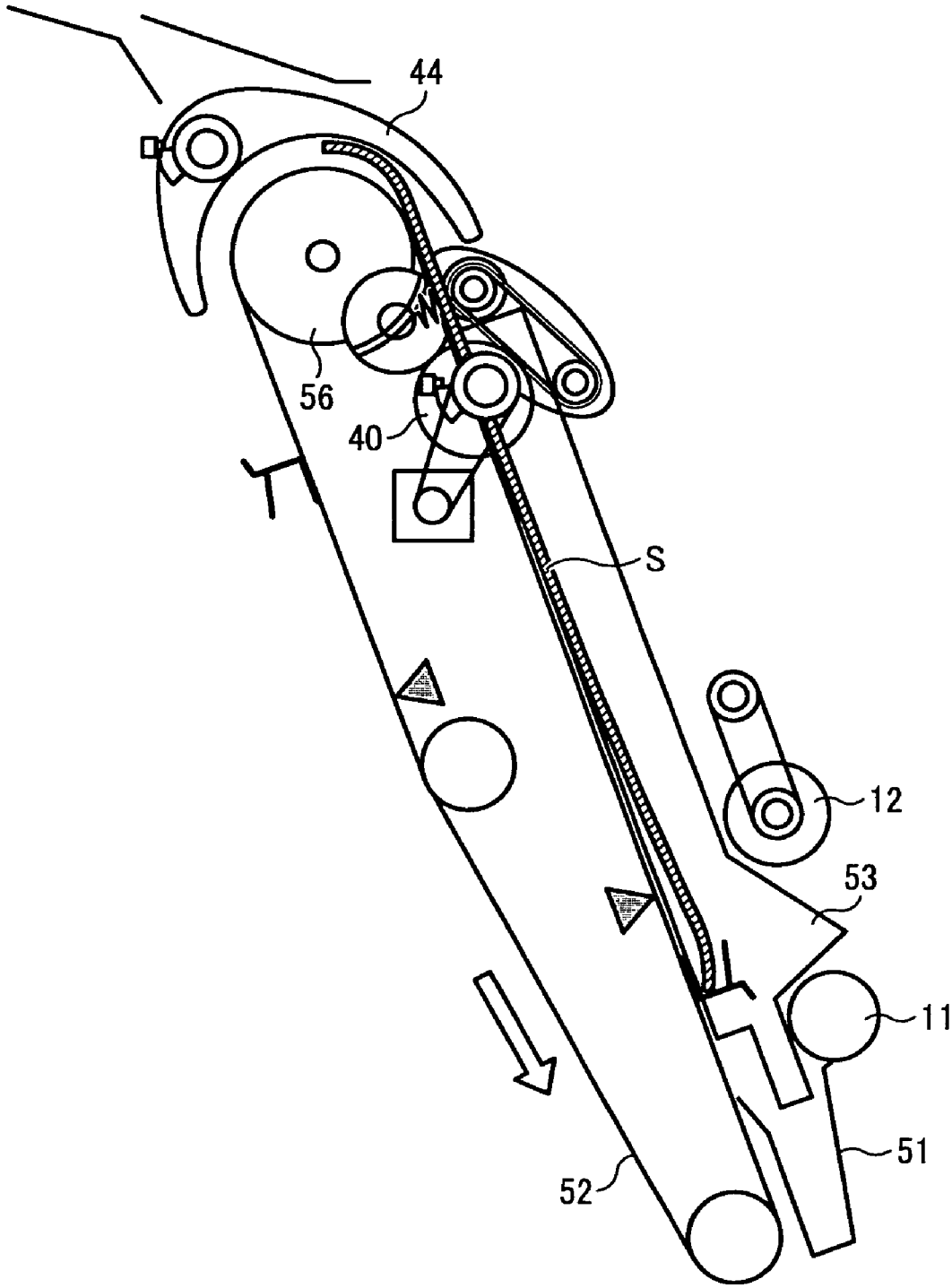

After a set of sheets (hereinafter, "sheet set S") is roughly aligned at the side-stitch tray F, the sheet set S is lifted up with the lifting claw 52*a*. As shown in FIG. 4, a front end of the sheet set S is conveyed to a position between an inner circumference of the guiding member 44 and the lifting rollers 56, passed between a roller 36 and a driven roller 42 that are in an open position in which a distance between the roller 36 and the driven roller 42 is wider than a thick of the sheet set S. After that, the roller 36 swings to a close position by a motor Ml and a cam 40, and the sheet set S is nipped by the roller 36 and the driven roller 42 with a predetermined pressure. The sheet set S is then conveyed to the saddle-stitch tray G by the rotation of the roller 36 and the lifting rollers 56 as shown in FIG. 5. The roller 36 rotates by a timing belt 38. The lifting rollers 56 that are attached to the driving shaft of the lifting belt 52 rotate in synchronization with the lifting belt 52.

Figure 6:
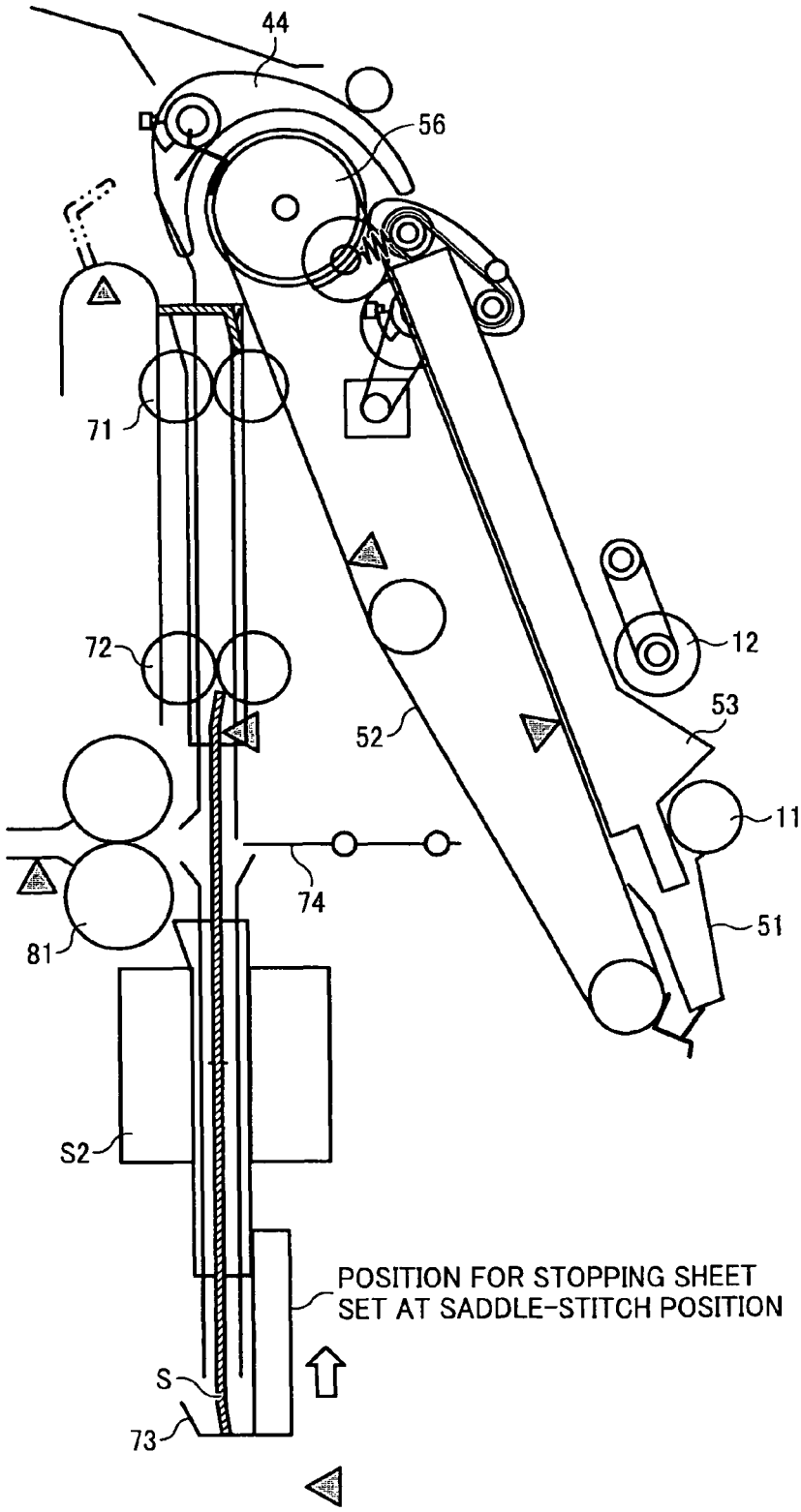
Figure 7:
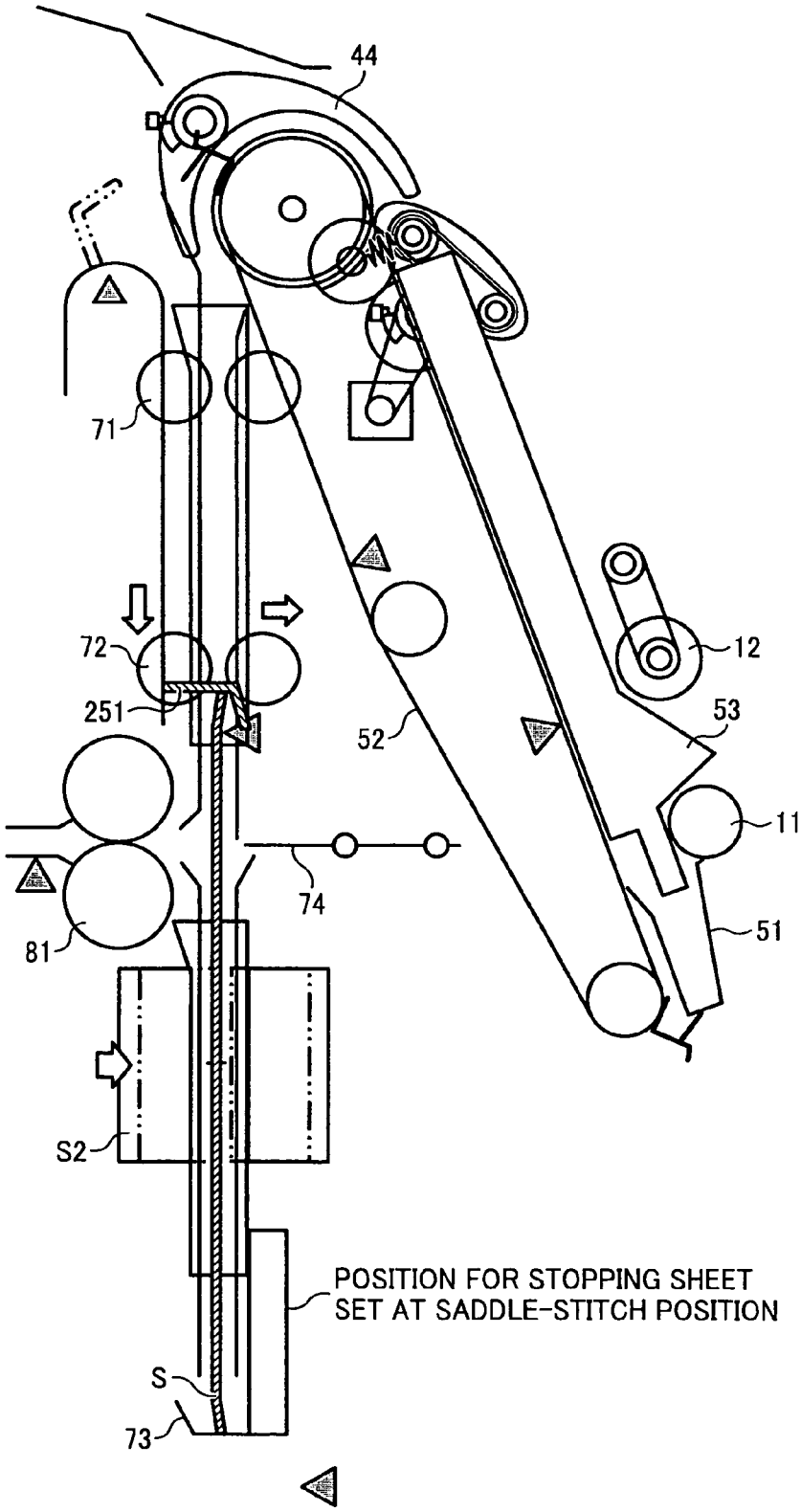

In the saddle-stitch tray G, the sheet set S is conveyed with a pair of upper conveyer rollers 71 and a pair of lower conveyer rollers 72 (72*a*, 72*b*) to a position at which the front end of the sheet set S abuts against a movable backend fence 73 as shown in FIG. 6. The position of the movable backend fence 73 depends on a length of the sheets. When the front end of the sheet set S abuts against the movable backend fence 73, the lower conveyer rollers 72 apart from each other and a back end of the sheet set S is tapped with a tapping claw 251 as shown in FIG. 7. Thus, the sheet set S is finely aligned with respect to the sheet conveying direction. In this manner, even when the alignment of the sheet set S breaks during the travel from the side-stitch tray F to the movable backend fence 73, the tapping with the tapping claw 251 makes the sheet set S aligned.

Figure 8:
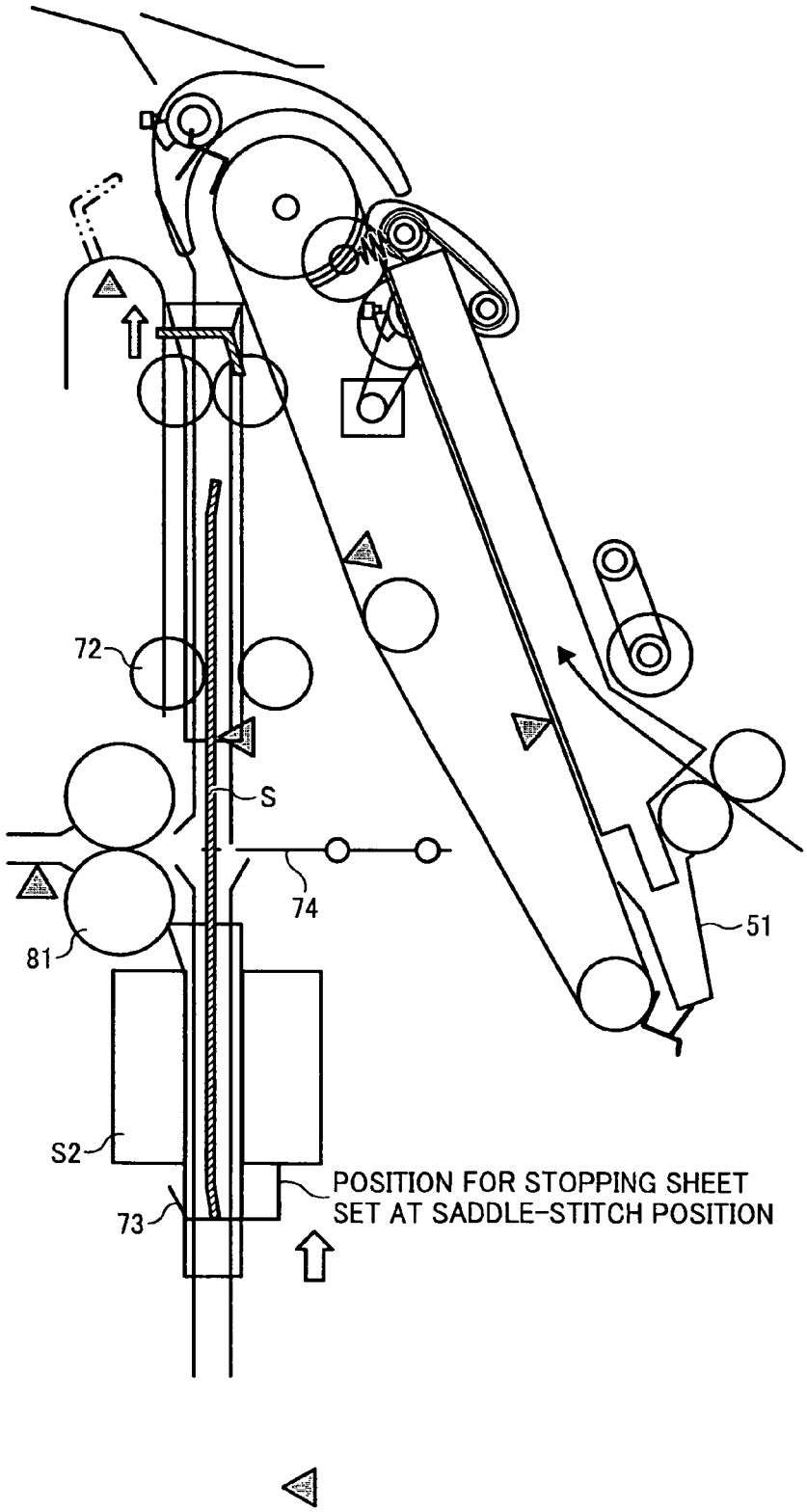
Figure 9:
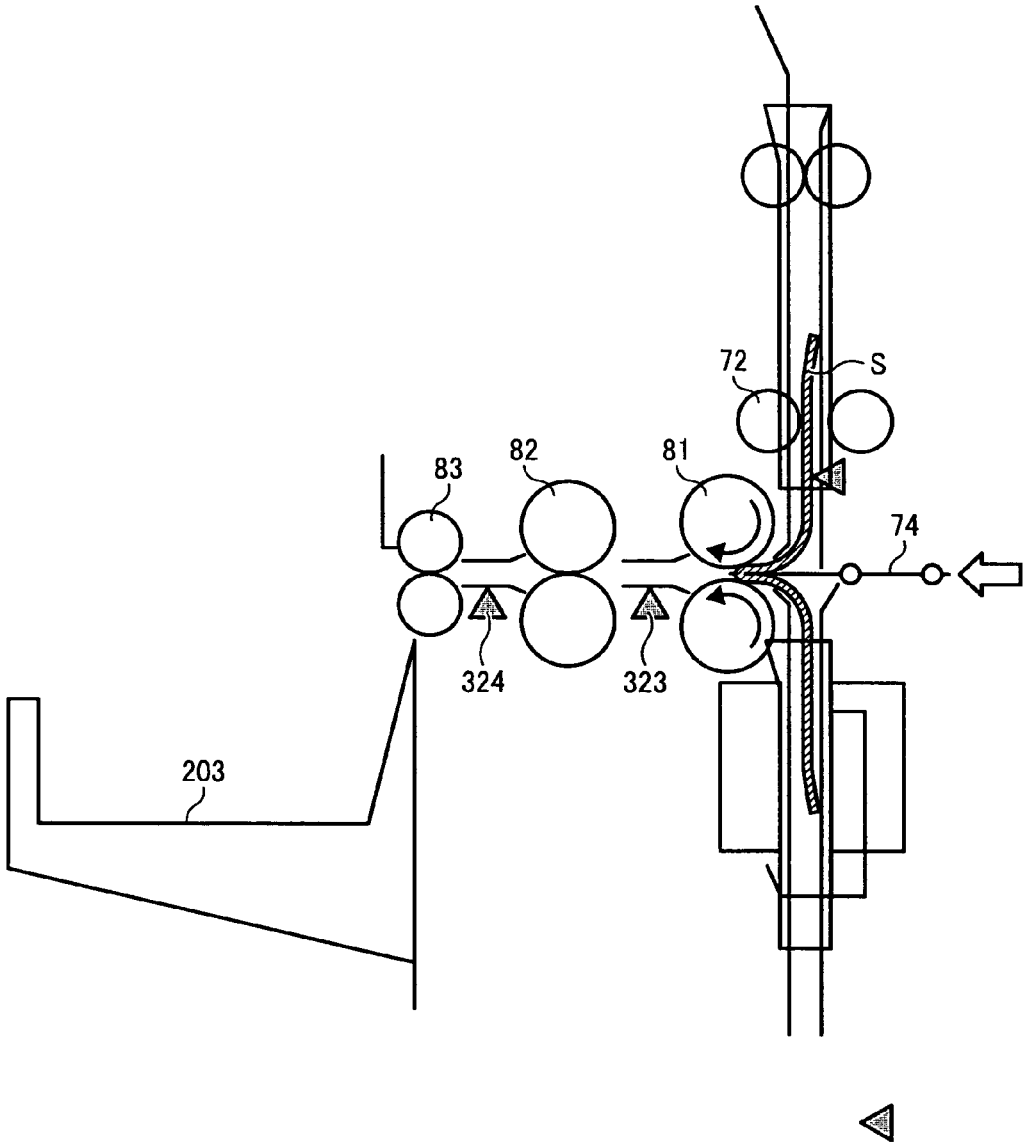

The sheet set S, the movable backend fence 73, and the relative members shown in FIG. 8 are in saddle-stitch positions. The sheet set S is aligned with respect to its width with the upper saddle-stitch jogger fence 250*a* and the lower saddle-stitch jogger fence 250*b*. The saddle-stitch stapler S2 staples a center position of the aligned sheet set S. It is noted that the position of the movable backend fence 73 is decided based on a pulse from a backend-fence HP sensor 322, and the position of the tapping claw 251 is decided based on a pulse from a tapping-claw HP sensor 326.

As shown in FIG. 8, while the lower conveyer rollers 72 apart from each other, the movable backend fence 73 lifts the stapled sheet set S up to a position so that the center position, i.e., the stapled position is aligned with the folding plate 74. After that, the folding plate 74 inserts the center position into between the rotating first pressure rollers 81 by pressing the center position in a direction perpendicular to the surface of the sheet set S. The rotating first pressure rollers 81 nip the sheet set S, and convey the sheet set S with a pressure. Thus, a crease is made on the center of the sheet set S. In this manner, the stapled sheet set S is lifted up to the position for folding without fails only by the movement of the movable backend fence 73.

Figure 10:
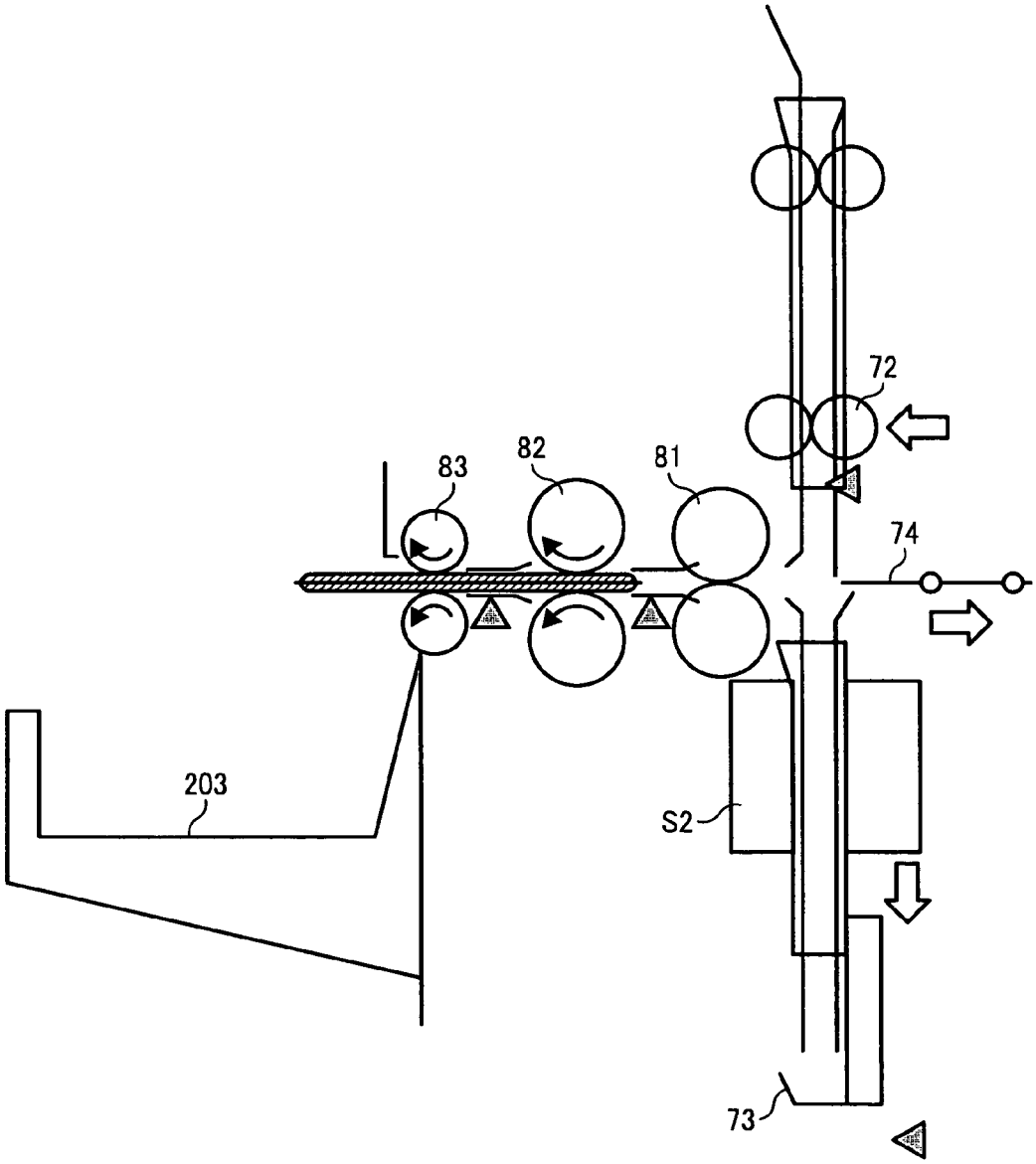

As shown in FIG. 10, the crease of the folded sheet set S is made stronger, re-pressed by a pair of second pressure rollers 82. The re-pressed sheet set S are ejected onto the lower tray 203 via a pair of ejection rollers 83. When it is determined using a sheet sensor 323 that the back end of the sheet set S has been passed through the sheet sensor 323, those members of the saddle-stitch tray G prepare for the next saddle stitch, more particularly, the folding plate 74 and the movable backend fence 73 return to the HPs and the lower conveyer rollers 72 return to a nip position for forming the nip. If a sheet size and number of sheets of the next set of sheets are same as the sheet set S, the movable backend fence 73 may move directly to the position shown in FIG. 2 instead of the HP. Whether the sheet set S is stacked on the lower tray 203 is determined based on the position of the back end of the sheet set S detected using a sheet sensor 324. The second pressure rollers 82 are not shown in FIG. 1. It is possible to design, based on its design conditions, the sheet creaser without provided with the second pressure rollers 82.

Figure 11:
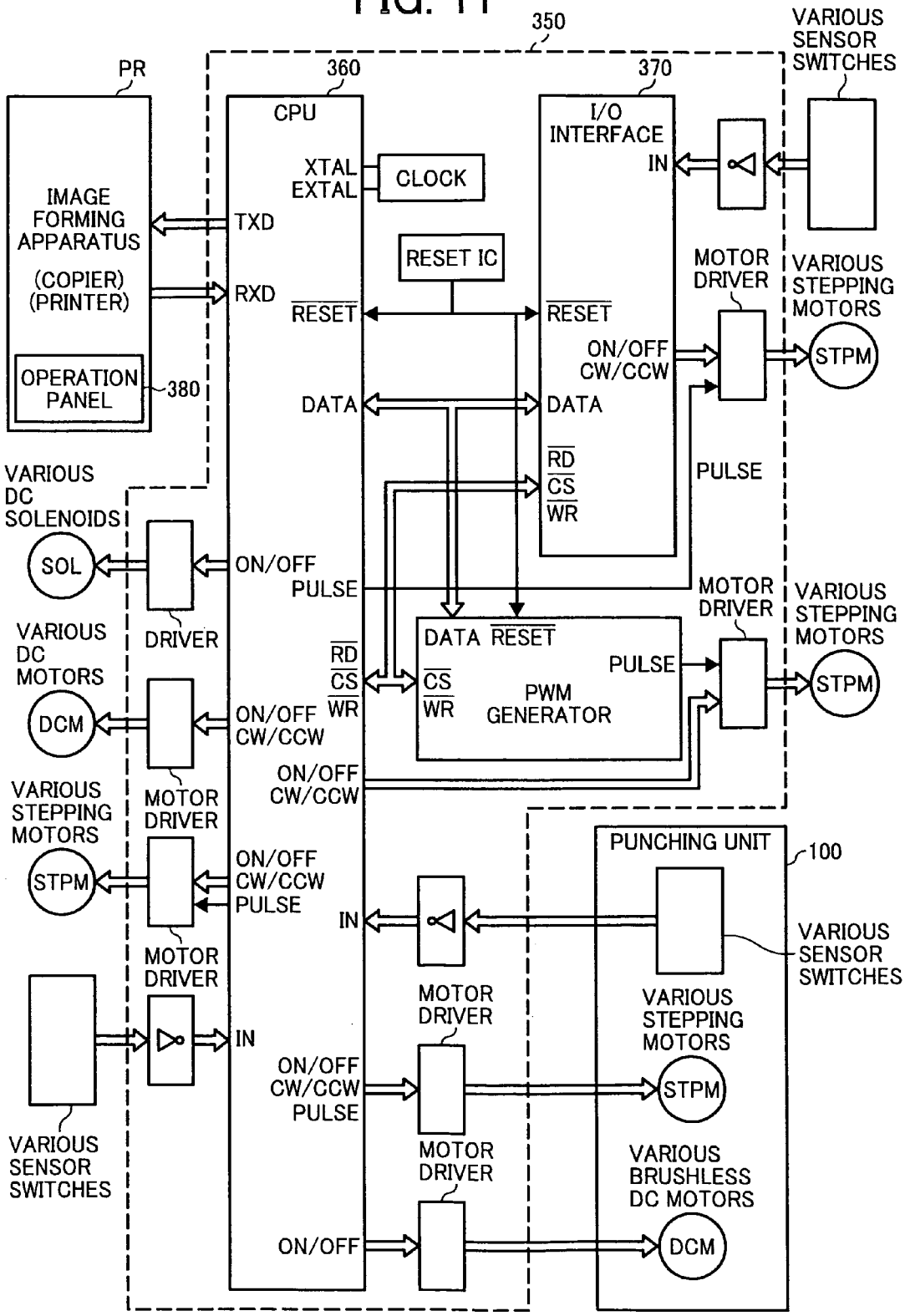
FIG. 11 is a block diagram of the control structure of the system according to the embodiment.

FIG. 11 is a block diagram of the control structure of the system according to the embodiment. The control circuit 350 that controls the sheet finisher PD can be a micro computer, including a central processing unit (CPU) 360 and an input/output interface (I/O interface) 370. The CPU 360 receives via the I/O interface 370 various signals from various switches on an operation panel 380 of the image forming apparatus PR and from various sensors such as the sheet sensor 330. The CPU 360 controls, based on the received signals, various components including the motor that lifts up/down the shift tray 202, the motor that opens/closes the open/close guiding plate, the motor that shifts the shift tray 202, the motor that drives the reverse roller 12, various solenoids including the tapping solenoid, the motors that drive various conveyer rollers, the motors that drive various ejection rollers, the motor that drives the lifting belt 52, the motor that moves the side-stitch stapler S1, the motor that rotates the side-stitch stapler S1 to a slant position, the motor that moves the jogger fences 53, the motor that swings the guiding member 44, the motor that drives the lifting rollers 56, the motor that moves the movable backend fence 73, the motor that moves the folding plate 74, the motor that drives the first pressure rollers 81. The motor that drives the stapled-sheet conveyer rollers 11 sends a pulse signal to the CPU 360. Upon receiving the pulse signal, the CPU 360 counts the received pulse signal and controls a solenoid 170 (not shown) and a jogger motor 158 (not shown) based on a result of count.

The CPU 360 controls those components by reading program codes from a read only memory (ROM) (not shown), loading the program codes on a work area of a random access memory (RAM) (not shown), and executing the loaded program codes.

Figure 12:
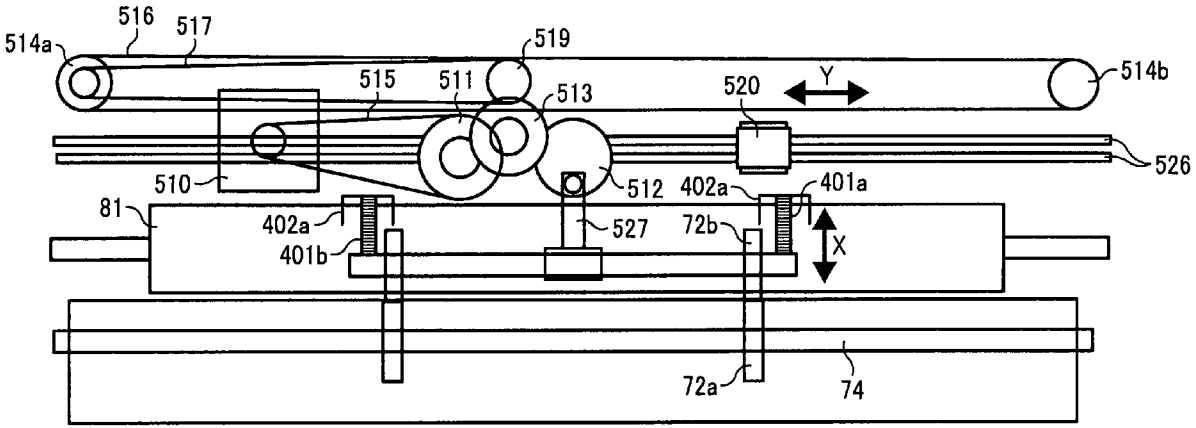
FIG. 12 is a schematic diagram for explaining close/apart operations of a lower conveyer roller viewed from the top side of the sheet finisher, depicting a state where the lower conveyer roller is in a position to convey a sheet between them (hereinafter, "nip position")
Figure 13:
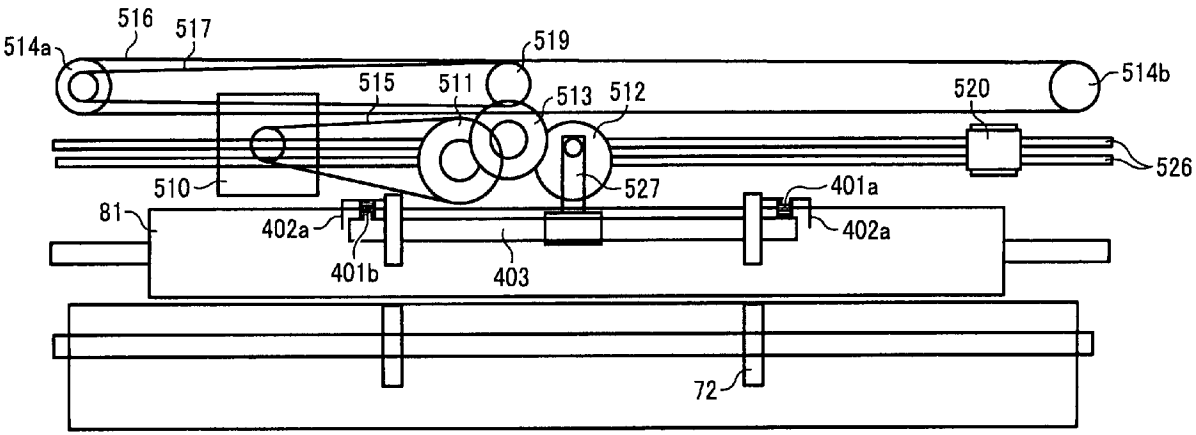
FIG. 13 is a schematic diagram for explaining the close/apart operations of the lower conveyer roller viewed from the top side of the sheet finisher, depicting a state where a slidable pressure roller is in stand-by positioning at a first end and the lower conveyer roller is in a position unable to convey a sheet between them (hereinafter, "release position")
Figure 14:
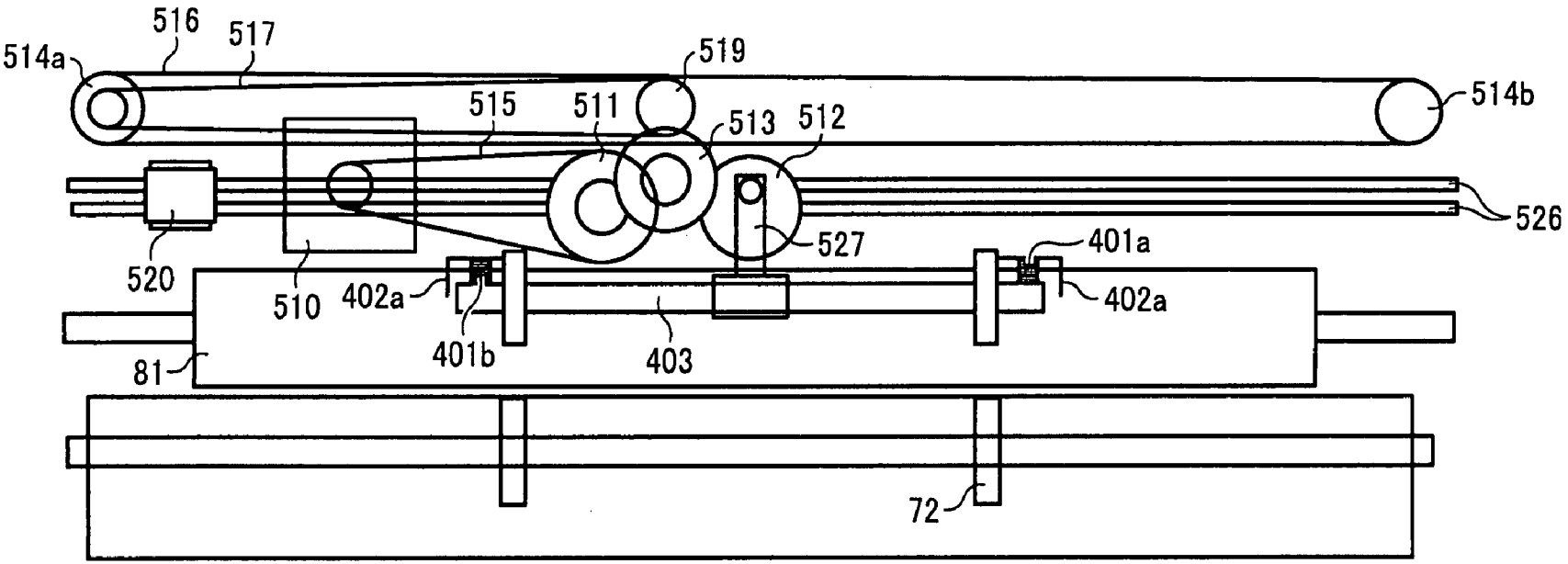
FIG. 14 is a schematic diagram for explaining the close/apart operations of the lower conveyer roller viewed from the top side of the sheet finisher, depicting a state where the slidable pressure roller is in stand-by positioning at a second end that is opposite to the first end.
Figure 17:
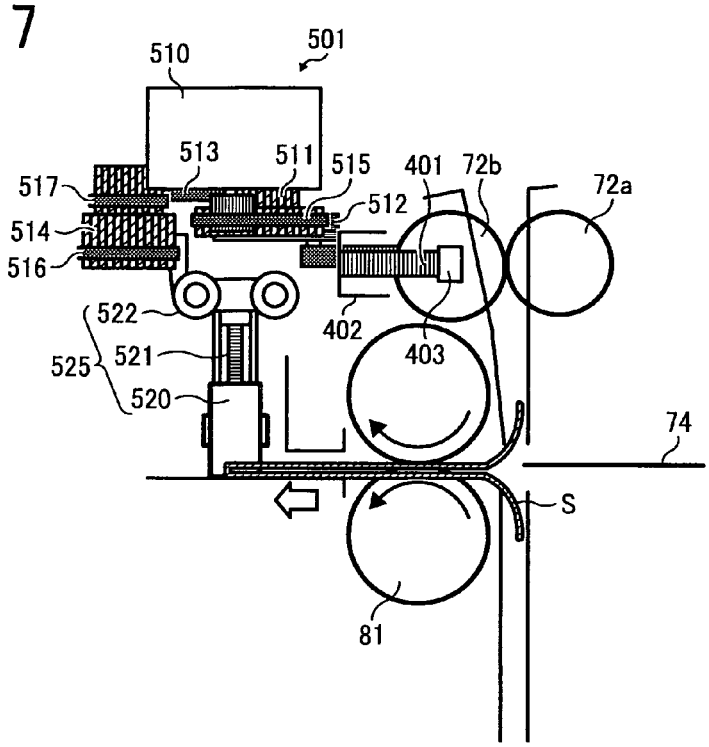
FIG. 17 is a schematic diagram for explaining the close/apart operations of the lower conveyer roller viewed from the front side of the sheet finisher, depicting a state where the slidable pressure roller just slides up on a crease of a sheet set.
Figure 18:
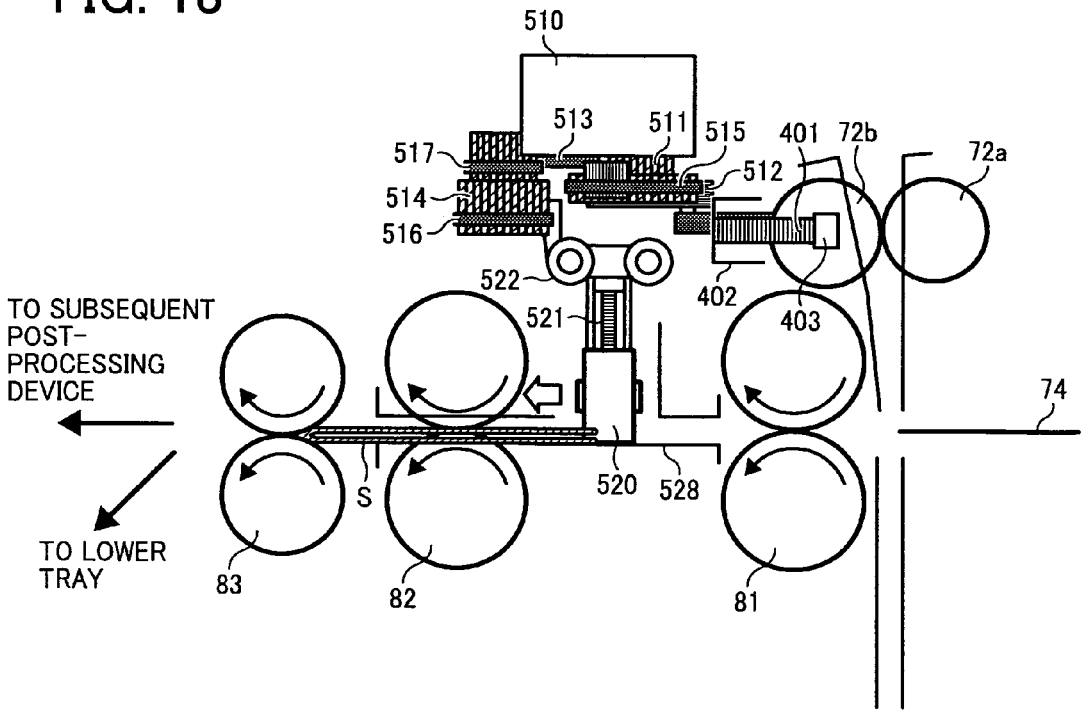
FIG. 18 is a schematic diagram for explaining the close/apart operations of the lower conveyer roller viewed from the front side of the sheet finisher, depicting a state where the sheet set is being ejected at the end of a slide-pressing operation.
Figure 19:
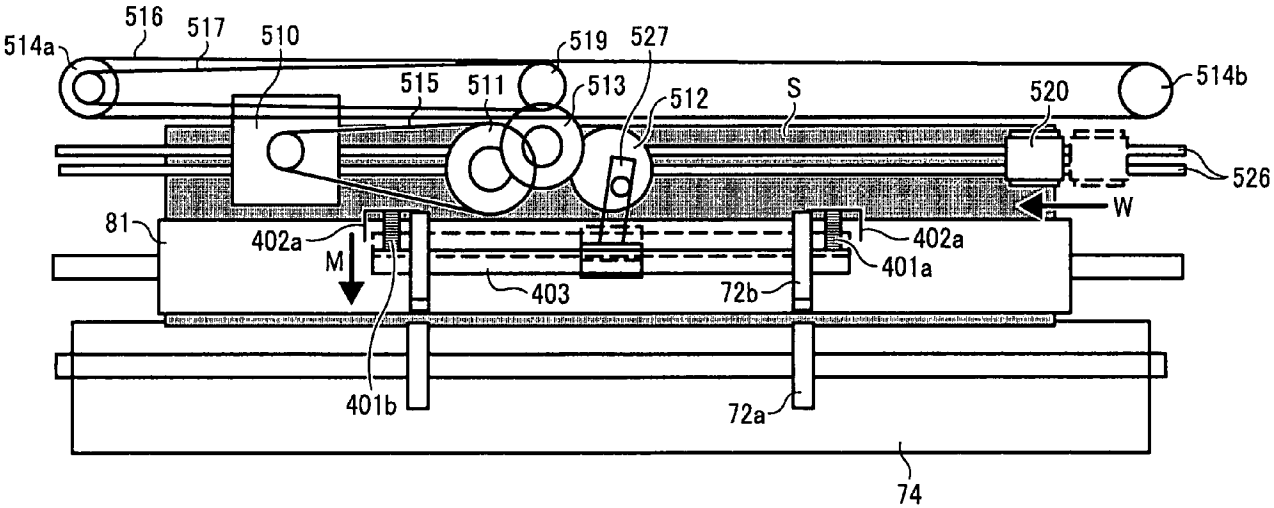
FIG. 19 is a schematic diagram depicting a state where the slidable pressure roller starts sliding in a sliding direction, at the same time, the lower conveyer roller moves toward the nip position and compression springs extend.
Figure 20:
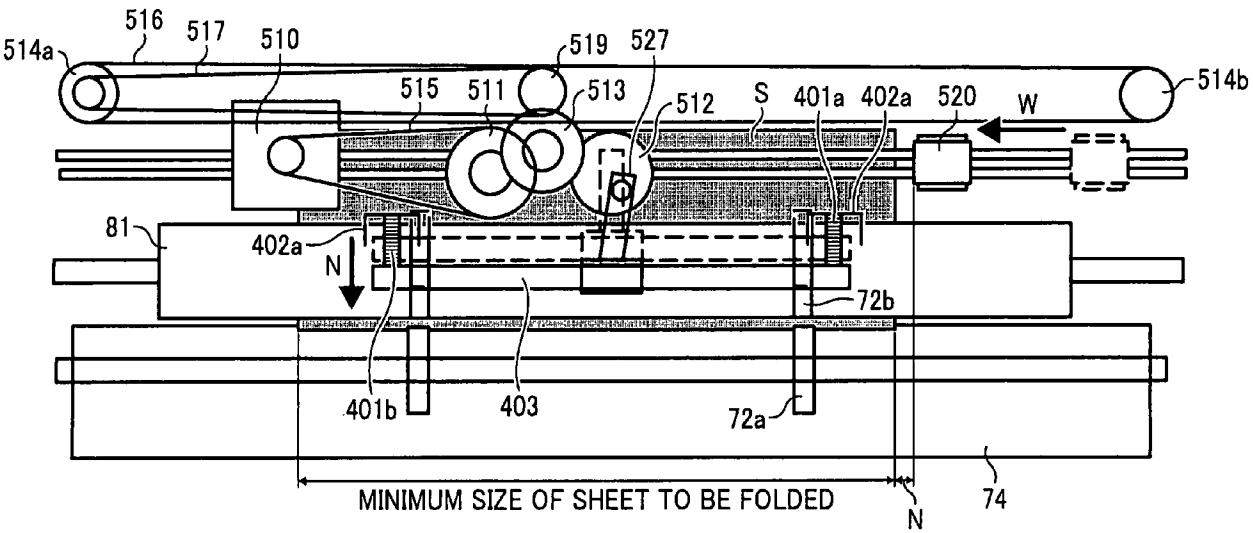
FIG. 20 is a schematic diagram for explaining the slide-pressing operation when the sheet S is a small size.

FIGS. 12 to 18 are schematic diagrams for explaining close/apart operations of the lower conveyer rollers 72*a* moving to/from the lower conveyer roller 72*a*. The close/apart operations are synchronized with the slide-pressing operation. FIGS. 12 to 14 are viewed from the top side of the sheet finisher PD; and FIGS. 15 to 18 are viewed from the front side of the sheet finisher PD. FIG. 19 is a schematic diagram for explaining the slide-pressing operation when the sheet set S is a large size. FIG. 20 is a schematic diagram for explaining the slide-pressing operation when the sheet set S is a small size. The operations of the slidable pressure roller 520 and the lower conveyer rollers 72 are descried below.

As shown in FIG. 1, the slidable pressure roller 520 is arranged between the first pressure rollers 81 and the second pressure rollers 82. The slidable pressure roller 520 re-presses the sheet set S, sliding in the direction perpendicular to the sheet conveying direction in the same manner as the conventional slidable pressure rollers disclosed in Japanese Patent Application Laid-open No. S62-16987 and Japanese Patent Application Laid-open No. 2005-162345. More particularly, while the lower conveyer roller 72*b* releases the pressure by moving in a direction indicated by an arrow X shown in FIG. 12, the slidable pressure roller 520 performs the slide-pressing operation by sliding in a direction indicated by an arrow Y.

Figure 15:
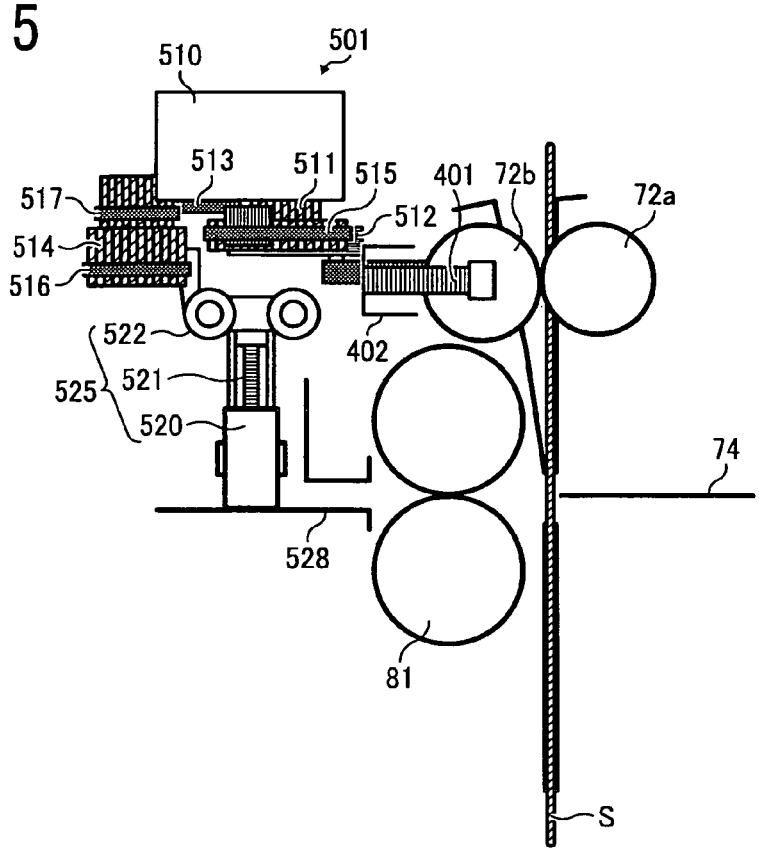
FIG. 15 is a schematic diagram for explaining the close/apart operations of the lower conveyer roller viewed from the front side of the sheet finisher, depicting the state where the lower conveyer roller is in the nip position.

FIG. 15 depicts a state where the half-folding operation starts. The half-folding mechanism includes a half-folding unit including the first pressure rollers 81 and the folding plate 74, the slide-pressing unit 525 including the slidable pressure roller 520, and the second pressure rollers 82. The slide-pressing unit 525 includes the slidable pressure roller 520, a compression spring 521, and a slider 522. The slider 522 is attached to a pair of guiding rods 526, slidable along them. The guiding rods 526 are arranged between a front plate and a back plate parallel to the direction perpendicular to the sheet conveying direction. The slidable pressure roller 520 slides in the rotating manner, while pressing with a predetermined force. The slide-pressing unit 525 performs the slide-pressing by using the slidable pressure roller 520 sliding on the crease of the sheet set S in the direction perpendicular to the sheet conveying direction. More particularly, the slidable pressure roller 520 is pressed by an elastic force of the compression spring 521, and the slider 522 with the pressed slidable pressure roller 520 slides along the guiding rods 526 on the crease of the sheet set S. Thus, the elastic force of the compression spring 521 makes the crease stronger. The slidable pressure roller 520 presses the sheet set S against a sheet supporting plate 528, which makes it possible to nip the sheet set S with the predetermined pressure.

A driving mechanism 501 arranged over the slide-pressing unit 525 drives the slidable pressure roller 520 and the lower conveyer rollers 72. The driving mechanism 501 includes a pressure-release motor 510, a pressure-release gear 512, a slidable pressure-roller driving gear 519, and slidable pressure-roller driving pulleys 514. The slidable pressure-roller driving pulleys 514 include a driving pulley 514*a* and a driven pulley 514*b* as shown in FIG. 12. The pressure-release gear 512 moves by rotation of a driving-force transmission belt 515 via a transmission gear 513. The driving-force transmission belt 515 rotates between a pulley that is attached to a rotation shaft of the pressure-release motor 510 and a driving-force transmission gear 511. The transmission gear 513 is merged with the slidable pressure-roller driving gear 519 (see FIG. 12). With this configuration, both the pressure-release gear 512 and the slidable pressure-roller driving gear 519 rotate by the driving of the pressure-release motor 510.

As shown in FIG. 15, a lever 527 (not shown) is arranged near a circumference of a bottom surface of the pressure-release gear 512. The lever 527 is rotatably attached to a center of a driven shaft 403 of one of the lower conveyer rollers 72 that is closer to the first pressure rollers 81 (i.e., the lower conveyer roller 72*b*). With this configuration, the driven shaft 403 moves linearly close to or apart from the other lower conveyer roller 72 (i.e., the lower conveyer roller 72*a*) by rotation of the pressure-release gear 512, which makes it possible to nip and release the sheet set S.

To move the lower conveyer roller 72*b* to/from the lower conveyer roller 72*a* and convey the sheet set S that is nipped by the lower conveyer rollers 72*a* and 72*b*, an end of a compression spring 401 is fixed to a fixing plate 402, and the other end presses with an elastic force the driven shaft 403 of the lower conveyer roller 72*b* to the lower conveyer roller 72*a*. The lower conveyer roller 72*a* is a driving roller, and the lower conveyer roller 72*b* is a driven roller. The lower conveyer roller 72*a* and a driving roller of the upper conveyer rollers 71 have a common driving source. When the lower conveyer roller 72*b* presses the sheet set S against the rotating lower conveyer roller 72*a*, the sheet set S between the lower conveyer rollers 72 is conveyed. Two compression springs 401*a* and 401*b* and two fixing plates 402*a* and 402*b* are shown in FIG. 12. The compression spring 401*a* that is fixed to the fixing plate 402*a* presses one end of the driven shaft 403, and the compression spring 401*b* that is fixed to the fixing plate 402*b* presses the other end of the driven shaft 403. The driving-force transmission gear 511, the pressure-release gear 512, the transmission gear 513, the lever 527, the driven shaft 403, and the compression springs 401*a* and 401*b* forms a link mechanism for moving the lower conveyer roller 72*b* to/from the lower conveyer roller 72*a*.

A slidable pressure-roller driving belt 517 rotates between the slidable pressure-roller driving gear 519 and the driving pulley 514*a*. The slidable pressure-roller driving belt 517 transmits the driving force of the pressure-release motor 510 to the driving pulley 514*a*. A slidable pressure-roller sliding belt 516 rotates between the driving pulley 514*a* and the driven pulley 514*b*. The slider 522 that supports the slidable pressure roller 520 is attached to the slidable pressure-roller sliding belt 516. In other words, the relative positions of the driving pulley 514*a* and the driven pulley 514*b* are decided so that the slidable pressure-roller sliding belt 516 runs parallel to the guiding rods 526.

With this configuration of the half-folding mechanism, the lower conveyer roller 72*b* moves close to or apart from the lower conveyer roller 72*a* by the operation of the link mechanism including the lever 527. When the sheet set S is to be conveyed through the saddle-stitch tray G, the pressure release operation is performed. The slidable pressure roller 520 re-presses the sheet set S by sliding in the direction perpendicular to the sheet conveying direction. In other words, the lower conveyer roller 72*b* moves apart from the lower conveyer roller 72*a* between the situations shown in FIG. 15 (FIG. 7) and FIG. 16 (FIG. 8). After the sheet set S is released from the lower conveyer rollers 72*a* and 72*b*, the sheet set S is half-folded with the folding plate 74 and the first pressure rollers 81.

In this manner, the lower conveyer roller 72*b* and the slidable pressure roller 520 receive the driving force of the pressure-release motor 510 via the driving-force transmission belt 515 and the driving-force transmission gear 511, and move by the received driving force. The received driving force is transmitted to the pressure-release gear 512 and the slidable pressure-roller driving gear 519 via the transmission gear 513. The driving force is further transmitted to the slidable pressure-roller driving pulleys 514 via the slidable pressure-roller driving belt 517, and thus the slidable pressure-roller sliding belt 516 rotates. As a result, the slidable pressure roller 520 is driven by the rotation of the slidable pressure-roller sliding belt 516.

Figure 16:
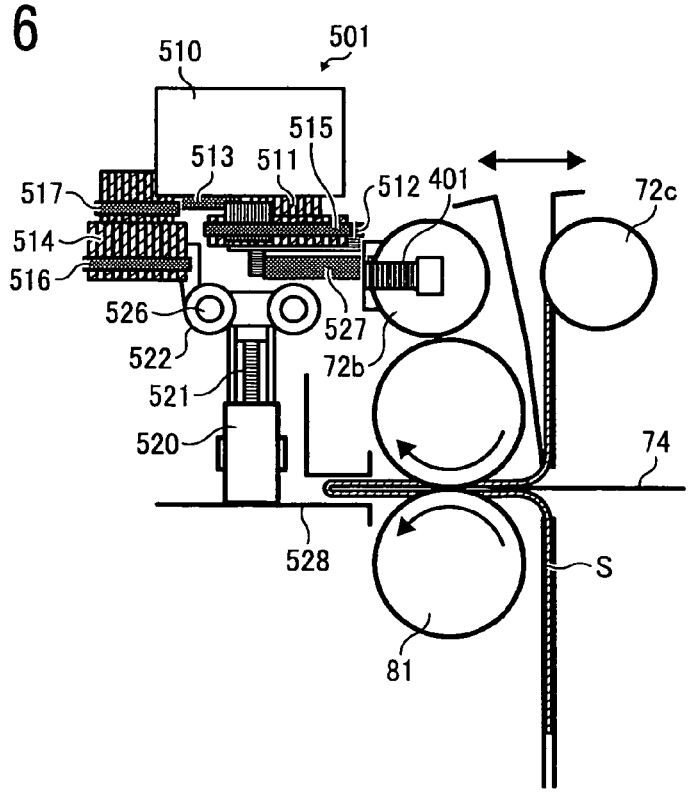
FIG. 16 is a schematic diagram for explaining the close/apart operations of the lower conveyer roller viewed from the front side of the sheet finisher, depicting a state where the slidable pressure roller is in stand-by and the lower conveyer roller is in the release position.

When the slidable pressure roller 520 is at the HP, the lower conveyer roller 72*b* is apart from the lower conveyer roller 72*a* (see FIGS. 13, 14, and 16). This configuration is effective to prevent a sheet jam, because the slidable pressure roller 520 keeps out of an area in which the sheet set S is to be conveyed while the first pressure rollers 81 presses the sheet set S.

FIG. 15 depicts a state where the sheet set S is being conveyed downward through the saddle-stitch tray G; FIG. 16 depicts a state where the half-folding is performed by the operation of the folding plate 74 and the first pressure rollers 81; FIG. 17 depicts a state where the slide-pressing operation starts; and FIG. 18 depicts a state where the slide-pressing operation ends.

After the crease is made on the center of the sheet set S by the first pressure rollers 81, the sheet set S is conveyed with the folded side being ahead and is stopped when the folded side is on a line along which the slidable pressure roller 520 slides (FIG. 17). The slidable pressure roller 520 slides on the folded side in the direction perpendicular to the sheet conveying direction. The slidable pressure roller 520 slides by the driving force of the pressure-release motor 510 in the half-folding mechanism. The lower conveyer rollers 72 are close to each other without nipping the sheet set S at that time. In other words, the sheet set S is held only by the first pressure rollers 81.

As shown in FIGS. 13 and 16, the nip pressure between the lower conveyer rollers 72 is released when the slidable pressure roller 520 is at the HP. This release state is made by the operation of the link mechanism including the lever 527. As shown in FIG. 14, when the slidable pressure roller 520 is at an end opposite to the HP within the slidable area, the nip pressure between the lower conveyer rollers 72 is also released. This is because, it is necessary, during the folding operation by the first pressure rollers 81, to keep the slidable pressure roller 520 out of the area in which the sheet set S is to be conveyed to prevent interference between the slidable pressure roller 520 and the sheet set S. That is, the slidable pressure roller 520 keeps out of the area corresponding to the sheet width.

If the number of sheets is small, the thickness of the sheet set S is small enough and the slide-pressing operation will be performed without any trouble. However, as shown in FIG. 17, if the sheet set S is thick, the slidable pressure roller 520 has to slide up on the folded side from the end of the sheet set S. When the slidable pressure roller 520 is at the HP or the stand-by position, the lower conveyer roller 72*b* is pressed toward the lower conveyer roller 72*a* by the elastic force of the compression springs 401. The compression springs 401 are fixed to the fixing plate 402 in such a manner that the elastic force can be surely transferred to the lower conveyer roller 72*b*.

FIG. 16 depicts a state where the elastic force onto the lower conveyer roller 72*b* is released, i.e., the compression springs 401 are shrunken. The folding operation is performed in this state. More particularly, the slidable pressure roller 520 stands-by at a position to receive the sheet set S indicated by a broken line shown in FIG. 19. After the folding process performed by the first pressure rollers 81 finishes, the sheet set S is conveyed to the slidable pressure roller 520 and then the slide-pressing operation by the slidable pressure roller 520 starts. As shown in FIG. 19, when the slidable pressure roller 520 starts sliding in a direction indicated by an arrow W, the lower conveyer roller 72*b* moves in a direction indicated by an arrow M, i.e., direction to which the compression springs 401 extend. This action of the compression springs 401 generates a force of causing the pressure-release gear 512 to rotate in the rotating direction as its reaction. Thus, the compression springs 401 helps the rotation of the pressure-release gear 512, which reduces the loads of the pressure-release motor 510. As a result, the slidable pressure roller 520 smoothly slides up on the sheet set S, even if the sheet set S is thick, by the stronger force that is combined the force of the pressure-release motor 510 with the force of the compression springs 401. This configuration is effective in preventing a step-out of the pressure-release motor 510. As shown in FIG. 20, for example, the amount of driving force of the pressure-release gear 512 that is necessary to move the lever 527 from a position indicated by a broken line (stand-by position of the lower conveyer roller 72*b*) to a position indicated by a full line decreases by an amount corresponding to the force of extension of the compression springs 401*a* and 401*b*.

As is found by comparing FIG. 19 with FIG. 20, the stand-by position of the slidable pressure roller 520 depends on the sheet size. As shown in FIG. 20, the nip pressure between the lower conveyer rollers 72 is not applied until the slidable pressure roller 520 reaches a position of a minimum size of sheet to be folded added with N mm. When the slidable pressure roller 520 slides up on the sheet set S, the compression springs 401 extend. The stand-by position of the slidable pressure roller 520 is set to the sheet width added with N mm. As a result, it is possible to shorten the period between when the slidable pressure roller 520 starts the slide-pressing operation and when the slidable pressure roller 520 slides up on the sheet set S.

The sheet creaser incorporated in the sheet finisher is described in the embodiment. However, the sheet creaser can be incorporated in a sheet conveyer, an image forming apparatus, an image forming system, or the like from viewpoints of space savings or cost savings. If the sheet creaser is incorporated in the sheet conveyer, the sheet creaser is, for example, placed upstream of a cutting device that cuts the sheet set S.

Although the number of sheets folded by the sheet creaser is plural in the embodiment, the sheet creaser can fold even a single sheet. If, for example, the single sheet is thick, the sheet creaser slide-presses the half-folded single sheet.

The embodiment of the present invention brings various effects as follows.

Firstly, the driving force of the pressure-release motor 510 is transmitted to a series of the gears 511, 512, and 513 via the driving-force transmission belt 515. With this configuration, the pressure-release motor 510 moves both the lever (link member) 527, i.e., the shaft attached to the lower conveyer roller 72*b* and the slidable pressure roller 520 in the direction perpendicular to the sheet conveying direction. In this manner, the single pressure-release motor 510 drives both the lower conveyer roller 72*b* and the slidable pressure roller 520, which makes it possible to reduce the required space and thereby reduce the size of the sheet creaser. Because no electromagnetic clutch is required as the switching unit, the costs are saved.

Secondly, in the half-folding operation, the folding plate 74 inserts the sheet or the sheet set S into the nip between the first pressure rollers 81, and the first pressure rollers 81 presses the inserted sheet or the inserted sheet set S. At that time, if the lower conveyer rollers 72 are in the nip position, the sheet or the sheet set S may tear when it is inserted into the nip between the first pressure rollers 81. To avoid the trouble, it is necessary to keep the lower conveyer rollers 72 in the release position during the half-folding. Moreover, it is necessary to keep the slidable pressure roller 520 out of the area corresponding to the sheet width to receive the half-folded sheet from the first pressure rollers 81. In the embodiment, the lower conveyer roller 72*b* and the slidable pressure roller 520 commonly use the single driving source so that they operate appropriately as described above. This makes it possible to implement the folding process with maintaining the productivity and reducing the costs.

Thirdly, the close/apart operation of the lower conveyer roller 72*b* and the slide-pressing operation of the slidable pressure roller 520 are implemented using the common driving torque generated by the single pressure-release motor 510. The pressure-release motor 510 is loaded most when the slidable pressure roller 520 slides up on the sheet set S. At that time, the compression springs 401 extend to move the lower conveyer roller 72*b* toward the lower conveyer roller 72*a*, which reduces the driving load of the pressure-release motor 510. As a result it is possible to prevent the step-out of the pressure-release motor 510 and save a part of energy.

Fourthly, to decrease the driving load in any sheet size, the lower conveyer rollers 72 keeps the release position until right before the slidable pressure roller 520 slides up on the minimum size of sheet to be folded. Alternatively, the stand-by position of the slidable pressure roller 520 depends on the sheet size, i.e., the slidable pressure roller 520 stands-by at the position of the sheet size added with N mm. This shortens time necessary for the slide-pressing operation.

According to an aspect of the present invention, it is possible to, in a sheet creaser including an additional folding unit that performs slide-pressing, reduce a space for the additional folding unit, thereby down-sizing the sheet creaser.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet creaser comprising:

a conveyer unit that receives a sheet set including at least one sheet and conveys the sheet set;

a folding unit that receives the sheet set from the conveyer unit and folds the sheet set along a folding line thereby obtaining a folded sheet set having a folded side;

a pressing unit that presses the folded side of the folded sheet set by sliding back and forth in a direction substantially perpendicular to a conveying direction of the sheet set;

a switching unit that switches the conveyer unit between a first position to convey the sheet set and a second position unable to convey the sheet set;

a driving unit that commonly drives the switching unit and the pressing unit, wherein the conveyer unit includes a first conveyer roller that rotates and a second conveyer roller that is moved close to or apart from the first conveyer roller by the switching unit, whereby the conveyer unit conveys the sheet set in such a manner the sheet set being nipped by the first conveyer roller and the second conveyer roller; and the driving unit moves the second conveyer roller close to or apart from the first conveyer roller depending on a position of the pressing unit; and a sliding mechanism that causes, by operation of a belt, the pressing unit to slide in a direction substantially parallel to a longitudinal direction of the folding unit; and a link mechanism that causes the second conveyer roller to move in a direction substantially perpendicular to the longitudinal direction of the folding unit, wherein the driving unit includes a motor as a common driving source for both the switching unit and the pressing unit: and a transmission mechanism that transmits rotation of the motor to both a slidable roller via the sliding mechanism and the second conveyer roller via the link mechanism.

2. The sheet creaser according to claim 1, wherein the folding unit includes a pair of rollers that nip the sheet set thereby making a crease on the sheet set; and a plate that pushes the sheet set between the rollers, and the pressing unit includes a sheet supporting member that supports the folded sheet by supporting a first surface of the folded sheet; and the slidable roller, the slidable roller being configured to slide on a second surface of the folded sheet along the crease.

3. The sheet creaser according to claim 2, wherein the conveyer unit includes a first biasing member, by exertion of an elastic force of which the conveyer unit conveys the sheet set, and when the pressing unit slides forth and slides up on the folded sheet, an elastic force from a second biasing member acts on the slidable roller to slide.

4. The sheet creaser according to claim 1, wherein when the sheet set is being folded by the folding unit, the switching unit causes the conveyer unit to be in the second position and keeps the pressing unit at a stand-by position.

5. The sheet creaser according to claim 4, wherein the stand-by position, at which the pressing unit is located when the sheet set is being folded by the folding unit, depends on a size of the sheet set.

6. The sheet creaser according to claim 1, wherein when the sheet set is being folded by the folding unit, the switching unit causes the conveyer unit to be in the second position, and when the folded sheet is being pressed by the pressing unit, the switching unit causes the conveyer unit to be in the first position.

7. The sheet creaser according to claim 1, wherein when the pressing unit is at an end of a slidable area to start sliding forth, the switching unit causes the conveyer unit to be in the second position.

8. The sheet creaser according to claim 1, wherein the switching unit causes the conveyer unit to stay in the second position until right before the pressing unit slides up on a minimum size of sheet to be folded.

9. The sheet creaser according to claim 1, wherein when the second conveyer roller is in contact with the first conveyer roller, the conveyer unit is in the first position, and when the second conveyer roller is apart from the first conveyer roller, the conveyer unit is in the second position.

10. A sheet conveyer comprising the sheet creaser according to claim 1.

11. A sheet finisher comprising the sheet creaser according to claim 1.

12. An image forming apparatus comprising the sheet finisher according to claim 11.

13. An image forming apparatus comprising the sheet creaser according to claim 1.

* * * * *